US006252550B1

(12) United States Patent
Vernon

(10) Patent No.: US 6,252,550 B1
(45) **Date of Patent: *Jun. 26, 2001**

(54) PLANAR ANTENNA DEVICE

(76) Inventor: Peter Joseph Vernon, 10 Camira Street, Maroubra NSW 2035 (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/098,771

(22) Filed: Jun. 17, 1998

(51) Int. Cl.[7] ..... H01Q 1/38; H01Q 11/12

(52) U.S. Cl. ..... 343/700 MS; 343/713; 343/742; 343/867

(58) Field of Search ..... 343/700 MS, 711, 343/712, 713, 702, 795, 828, 741, 742, 866, 867

(56) References Cited

U.S. PATENT DOCUMENTS 2,082,812 * 6/1937 Worrall ..... 343/867
3,390,394 * 6/1968 Glimvall ..... 343/742
5,198,826 * 3/1993 Ito ..... 343/726
5,363,114 11/1994 Shoemaker ..... 343/828
5,442,368 * 8/1995 Harada et al. ..... 343/713
5,714,965 * 2/1998 Taguchi ..... 343/701
5,757,328 * 5/1998 Saitoh ..... 343/742
5,973,650 * 10/1999 Nakanishi ..... 343/742

* cited by examiner

*Primary Examiner*—Tan Ho
(74) *Attorney, Agent, or Firm*—Akerman Senterfitt

(57) ABSTRACT

A planar antenna including a rectangular conductive element formed from two square elements. The square elements are defined within the rectangle by a centrally located return conductor. Each square element is connected at one end to a connector element, and at the other end to the return conductor. The dimensions of the square elements are chosen so as to maximize gain for selected radio frequencies. The invention further includes a method for providing conductive elements on a substrate, including the steps of printing a conductor pattern onto a substrate using conductive ink; and electrodeposition further conductive material onto the conductor pattern, using the pattern formed from conductive ink as an electrode in an electroplating process.

10 Claims, 3 Drawing Sheets

PLANAR ANTENNA DEVICE

TECHNICAL FIELD

The present invention relates to antennas intended to be affixed to surfaces, for use with radio frequency devices such as cellular phones, GPS location systems, and other RF applications. The present invention further relates to a method for manufacturing conductive patterns on substrates.

BACKGROUND ART

Many applications currently exist where an RF antenna is provided in order to enable communication—for example, cellular telephones, GPS systems, wireless data networks and the like. In some cases the antenna is provided with the device, for example as a stub unit on a cellular phone. In other cases, however, it is necessary to provide an externally connected antenna. Further, in applications such as in-car use of cellular phones, it is desirable to provide an additional antenna to boost signal strength. Traditional antennas for this purpose have been generally externally mounted on the vehicle. This increases wind noise, is prone to vandalism, and detracts from the appearance of the vehicle.

For any antenna application of this type, various issues need to be considered. Apart from addressing the problems mentioned above, the antenna should provide maximum capture area, whilst ideally being visually unobtrusive. It should be simple to install, yet electrically and structurally reliable.

It has been proposed to provide an antenna by adhering an array to the inside of a window of a motor vehicle. U.S. Pat. No. 5,363,114 to Shoemaker describes a planar, serpentine antenna which is adhered to a carrier layer, and which is then adhered to a suitable vehicle surface. The antenna is disclosed as having a serpentine patterned arrangement.

It is an object of the present invention to provide an improved antenna for mounting on planar surfaces.

SUMMARY OF INVENTION

According to one aspect the present invention provides a planar antenna. The planar antenna has a rectangular conductive element formed from two square elements. The square elements are defined within the rectangle by a centrally located return conductor. Each square element is connected at one end to a connector element, and at the other end to the return conductor. The dimensions of the square elements are chosen so as to maximize gain for selected radio frequencies. The antenna further includes one or more additional square elements disposed within the square elements. Each additional square element is connected to the respective square element at one end being defined by the return conductor on one side.

It will be understood that the term planar is intended to mean both flat surfaces and smooth curved surfaces, such as for example the shape of a vehicle windshield.

The inventive antenna arrangement has a number of advantages over the existing designs. The intended applications, where the antenna is adhered to an existing surface such as a window, do not require that the conductive elements be structurally rigid themselves, thereby enabling the use of a sparse geometry. This also enables the antenna to have a relatively large capture area, as it is mounted on a surface and not freestanding. Further, as there are elements disposed both horizontally and vertically, the antenna can receive either vertically or horizontally polarized signals well, which is advantageous in applications where scattering due to buildings and other structures occurs.

In the preferred implementation, the antenna also has the advantage of not requiring impedance matching electronics. A simple square antenna of the proportions of one of the square elements forming the antenna, with conductors 1 mm wide and 25 microns thick, has an impedance of about 100 ohms. Because the present antenna arrangement has in effect two impedances of this size in parallel, the impedance is about 50 ohms, and so the inventive antenna can be directly connected to a standard 50 ohm cable. This reduction in impedance is inherent in the design.

The present invention also provides a method for providing conductive elements for the antenna on a substrate, including the steps of:

printing a desired conductor pattern onto a substrate, using conductive ink; and electrodeposition further conductive material onto the conductor pattern, using the pattern formed from conductive ink as an electrode in an electroplating process.

The conductive material may be conveniently copper. The parameters of the electroplating process will depend upon the process selected, but should be such as to provide an adequate thickness of copper, but not so much that too much copper is deposited and the pattern becomes vulnerable to mechanical failure. The inventor has found that in the cellular phone application a thickness of about 25 microns is suitable.

The pattern is suitably printed using a screen printing process. In practice, a large sheet of flexible material can be printed and cut using a suitable tool to provide many antenna arrays.

After depositing, preferably a double sided adhesive film, preferably transparent, is applied both to provide a mechanism for adhesion to the desired surface, and to inhibit corrosion of the copper.

The inventors have investigated various methods for practical manufacture of the antenna. Whilst the invention arose in this context, it will be understood that the inventive method can equally be applied to manufacture of other conductor on substrate devices. The use of conductive ink alone did not provide suitable resistive properties for the antenna, and the addition of electrodepositing to the printing approach was only arrived at after significant trial and error.

BRIEF DESCRIPTION OF DRAWINGS

An embodiment of the present invention will now be described with reference to the accompanying drawings, in which.

DETAILED DESCRIPTION

The present invention is principally described in terms of a device designed to be adhered to a surface as an add-on device. However, it will be appreciated that the inventive antenna design could be formed as part of an article or within, for example, part of a vehicle, or a casing for an electronic device.

Figure 1:
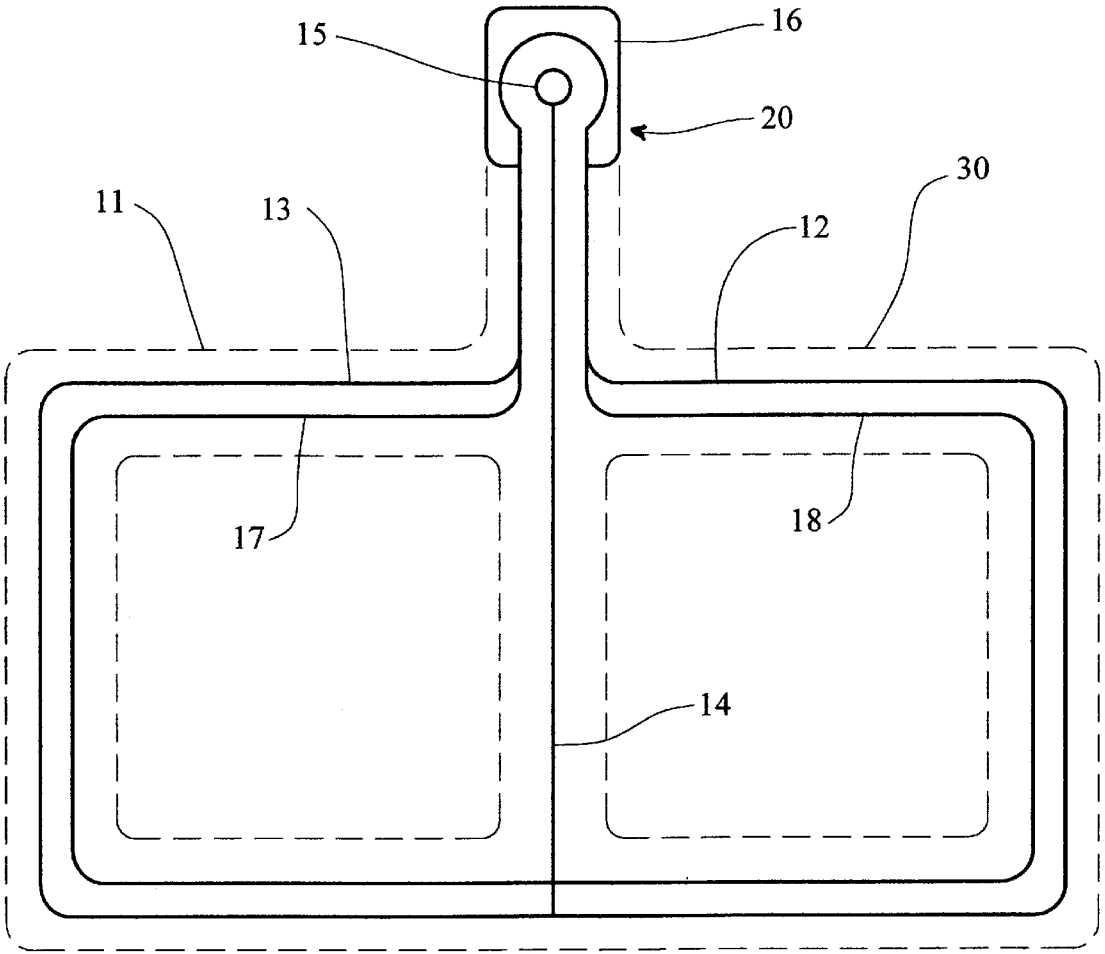
FIG. 1 is a plan view of one embodiment of the inventive device.

FIG. 1 shows an embodiment of the present invention suitable for use as a multi-band antenna on the bands for cellular telephone frequencies, Global Positioning Satellite (GPS) frequencies and Personal Communication System (PCS) frequencies.

Antenna 10 is generally rectangular in shape, and is formed with four elements 11, 12, 17 and 18. The two elements 11 and 12 are connected to the outer part 16 of connector element 20. The two elements 17 and 18 are provided respectively inside elements 12, 13, and are similarly connected to the outer part 16 of connector element 20. Central element 14 forms the common side of the square formed by each of elements 12, 13, 17 and 18, and is connected to the center component 15 of connector 20.

This design is based upon a recognition that for many applications reception on multiple bands is useful, and also that multiple harmonics of the 900 MHz band fall close to other bands, in this case the GPS band at 1575 MHz, and PCS band at 1800–2000 MHz. The elements 12 and 13 have dimensions suitable for 900 MHz +/−50 MHz. The central elements 17 and 18 allow for proper resonance on the GPS and PCS bands.

A full wave loop is a simple square. It is known that the gain of a full wave loop over an isotropic (point source) radiator is 3 dB. For two such loops being fed simultaneously the gain would be an additional 3 dB. However, considering loops 12 and 13, as the central element 14 is common to both loops, the realized gain is 4.5 dB. It will be understood that it is possible within the scope of the present invention to have further additional elements within elements 17, 18 if desired to provide additional band coverage for certain applications.

The antenna dimensions are shown on the figure. The tracks are desirably about 1 mm across and about 30 microns thick, including both the conductive ink and the copper. Although the corners are shown as right angles, the corners may be rounded if desired. The antenna elements are mounted on a sheet 11, shown in dotted outline, of suitable flexible material. This may be any suitable substrate, for example clear polyester, or any material used for flexible BCBs. It is preferred that the material be transparent, particularly for in-vehicle use, so as to minimize the obstruction to vision. In the applications discussed, the film is suitably between 75 and 300 microns thick.

The appropriate length for the elements of the antenna can be determined from the formula:

$$L=K/F$$

where L in the length, F is the frequency, and K is a constant which varies with the dielectric properties of the material surrounding the conductor. In the case of the implementation described, the dielectric properties of the substrate need to be considered. It will be appreciated that in use the dielectric properties of the surface adhered to, for example the windshield glass, will also be relevant to the constant K and consequently to the length L The inventor had difficulty in determining an appropriate manufacturing process for the present invention, and several problems became apparent. The standard technique used for flexible PCBs made from materials such as polyester is to screen print silver based polymer conductive ink, for example Acheson Electrodag 477SS. For the usual applications a resistivity of about 0.02 ohm/squares is acceptable. However, for high frequency radio signals, a lower resistivity is desirable, and the use of solid copper tracks was indicated. Although copper track flexible PCBs are used in other applications, the finished product produced is not acceptable for the present application. The material used is not suited chemically to standard PCB etching processes—particularly in terms of remaining transparent and of acceptable appearance after processing.

Figure 4:
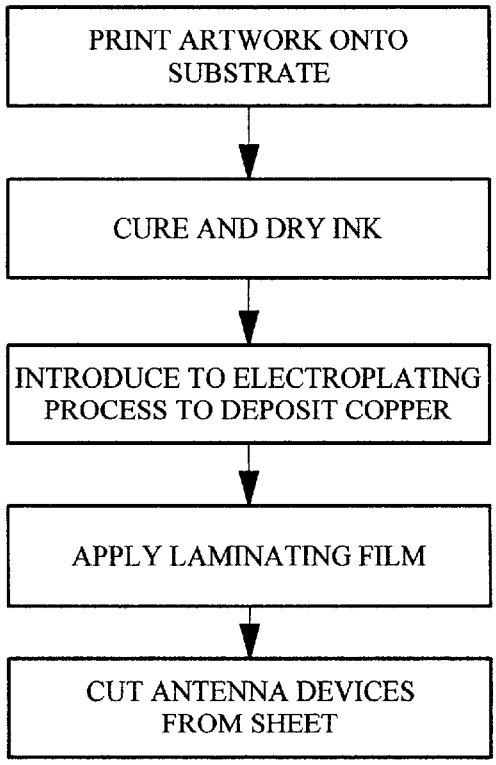
FIG. 4 is a flowchart illustrating the inventive process.

The inventive process is described by the flowchart shown in FIG. 4. Initially the desired art work is prepared. This in use will normally be many—for example 20—antenna units on a single sheet. The artwork is then screen printed onto the film using a suitable conductive ink. The screen printing must be done to a suitable level of detail—for example, using a 23—mesh stainless steel printing screen. This is then cured and dried as required for the ink—for example, using Acheson Electrodag 477SS for about 8 minutes at 150° C. in a conveyorized convection oven.

The sheet is then placed in an electroplating bath, with the conductors arranged to act as the depositing electrode. The solution, time and current will depend on the specific process used. However, particular care needs to be taken with current levels in the conductive tract. The electroplating should produce a sufficiently thick layer on the track, for example 25 microns. This provides an antenna with a track resistance of about 0.001 ohm/square, and leaves the substrate transparent.

In order to produce a bright and unblemished finish, the following steps are desirable. A fresh solution of electrolyte, for example Cuprax, should be used and must not have any form of contamination, for example from previous use of the solution. In standard electroplating some degree of contamination can be tolerated—this is not feasible for the present application.

Initial plating current is low, for example about 4 Amps for 5 minutes. This is so that a thin layer of copper is deposited on the conductive ink, and in turn carries the higher current required for normal electroplating processes. If a higher current is used, the conductive ink overheats causing potential problems. The conductive ink may separate from the substrate, or leave discoloration or burn marks. The final current used is 8–10 Amps for a further 10 minutes.

A double sided clear adhesive, for example 3M laminating adhesive, is then applied to the copper track side of the polyester film. This provides a means of attachment to the mounting surface, and inhibits oxidation of the copper. A suitable arrangement, for example a guillotine or knife tool, is then used to remove each antenna device from the film sheet.

Figure 3:
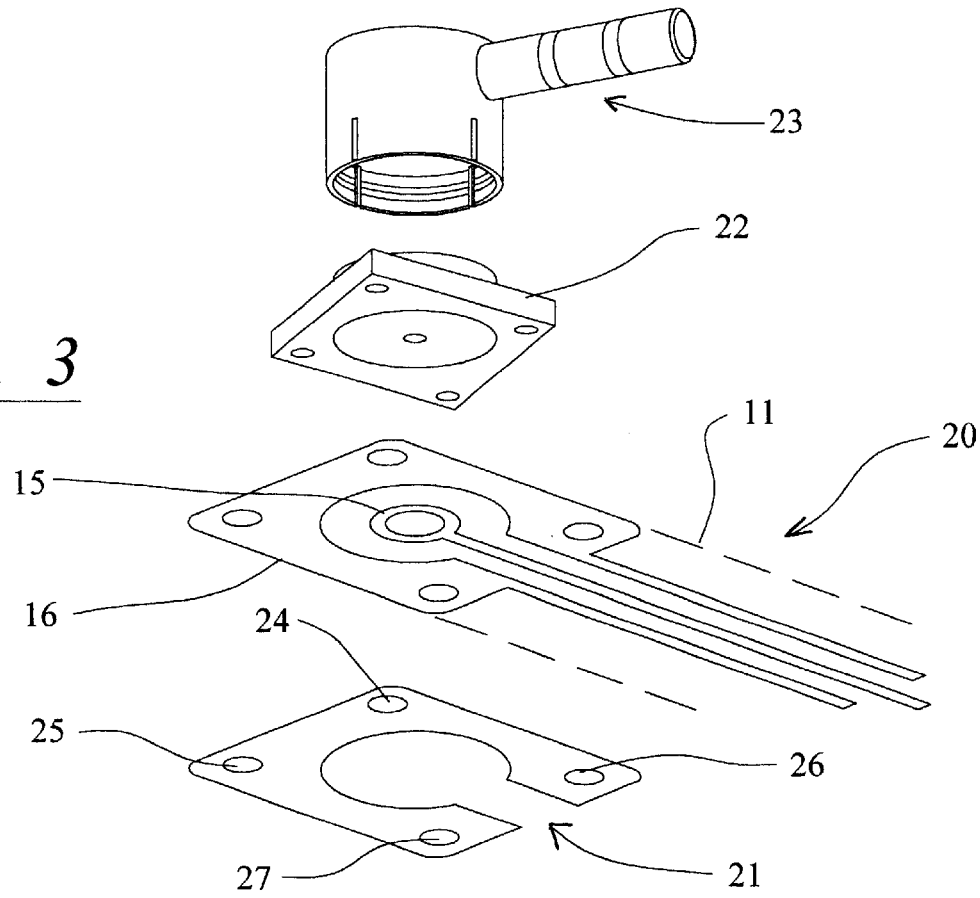
FIG. 3 is an exploded view of the connector arrangement.

A further problem relates to affixing a connector to the completed film antenna. The clear film used in the preferred implementation cannot tolerate the high temperatures involved with, for example, soldering. FIG. 3 shows in exploded view an arrangement developed by the inventor to enable connection.

Element 20 is the connection park of the copper track. It will be appreciated that this is held between the substrate film 11, and the double sided adhesive film (not shown) and so the contacts are not exposed for simple connection. Shim 21 is placed below element 20, and socket 22-above element 20. Conductive rivets, for example of brass, are inserted through the openings 24, 25, 26, 27 in the shim, through element 20, and though the corresponding holes in socket 22. This provides an electrical connection between the body of socket 22 and the outer part 16 of element 20. A further rivet passes through the central part 15 of element 20 and into the central part of socket 22. Plug 23 can then be readily connected, illustratively by a force-fit mechanical connection, so as to provide a cable link to the device for connection to the antenna.

Figure 2:
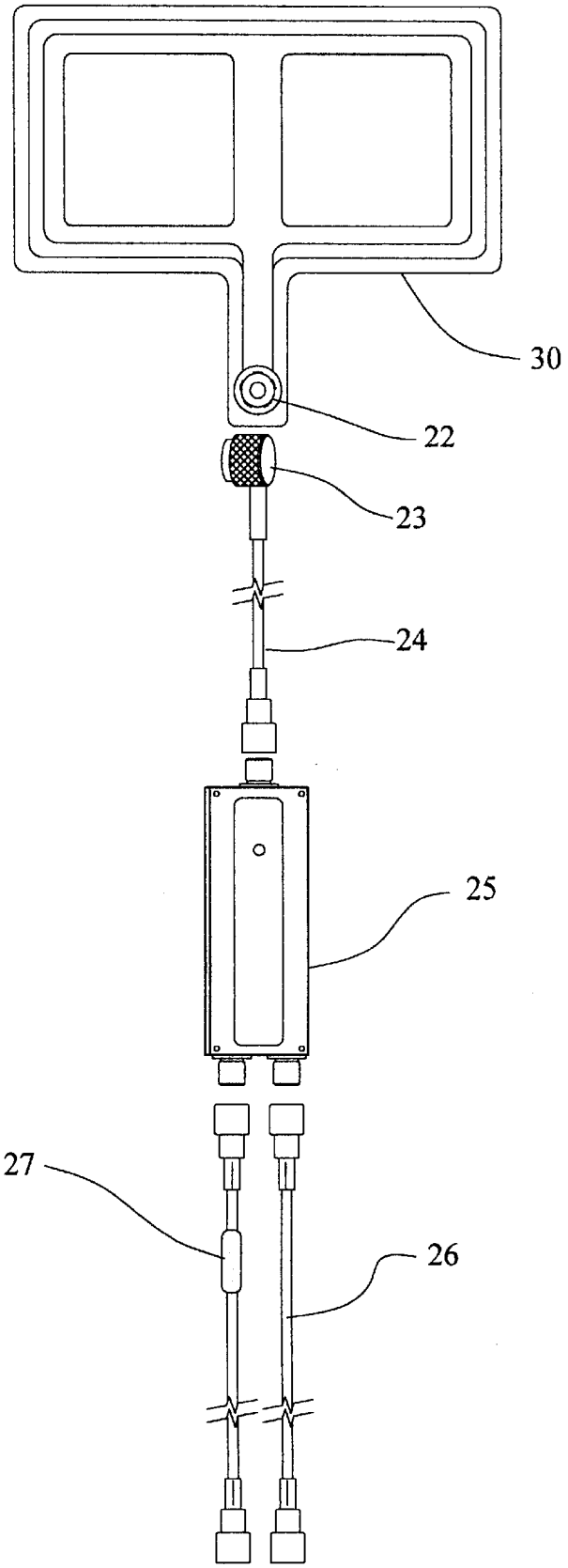
FIG. 2 is a schematic illustration showing connection of the device of FIG. 1 to enable multiple device connection.

FIG. 2 illustrates a connection arrangement for a device according to FIG. 1—where multiple bands are received, and it is desired to connect these to separate devices. Illustratively, these are a cellular phone and a GPS receiver. Antenna 30 is connected via socket 22 to plug 23 on cable

24. Cable 24 connects the antenna to antenna power splitter unit 25. This then provides a connection 26 for a cellular phone, and a connection 27 for a GPS receiver.

Devices suitable for use as the antenna power splitter 25 are commercially available. The function of this device is to isolate the output ports 26, 27 from each other so that the respective devices do not interfere with each other. In this specific context, the concern would be to ensure that the cellular phone's transmit energy does find its way to the GPS receiver. It is desirable that the antenna power splitter would have an isolation factor of at least —25 dB in this application. It will be appreciated that the necessary isolation will depend on the devices intended to be connected to the antenna 30.

It will be understood that while the present invention is described mostly in the context of an in-vehicle antenna could be adhered inside a window, many other applications exist. The inventive antenna could be adhered to an internal or external building wall, or used to implement a wireless LAN or other data network. It could be readily used, with modifications to suit band changes, for mobile or fixed data logging and transfer.

The inventive method could be applied wherever a highly conductive pattern is required, particularly where a transparent substrate is used.

What is claimed is:

1. A planar antenna, comprising:

a conductive element which is in the shape of a rectangle formed from two square elements, the square elements being defined within the rectangle of the conductive element by a centrally located return conductor, each said square element being connected at one end to a connector element, and at the other end to said return conductor, wherein the dimensions of the square elements are chosen so as to maximize gain for selected radio frequencies; and at least one additional square element disposed within said square elements, each additional square element being connected to the respective square element at one end and being defined by the return conductor on one side.

2. The antenna according to claim 1, wherein the conductive elements are formed on a substrate.

3. The antenna according to claim 2, wherein the substrate is a flexible film.

4. The antenna according to claim 3, wherein the substrate is transparent.

5. The antenna according to claim 2, wherein the substrate is transparent.

6. An antenna according to claim 2, wherein the conductive elements have been provided by a method that comprises the steps of:

printing a conductor pattern onto the substrate using conductive ink; and electrodepositing further conductive material onto the printed conductor pattern, using the pattern formed from conductive ink as an electrode in an electroplating process.

7. The antenna according to claim 6, wherein the conductor pattern is screen printed onto said substrate.

8. The antenna according to claim 7, wherein a plurality of conductor patterns are printed onto said substrate, and after electrodeposition a protective film is applied to the conductor pattern.

9. The antenna according to claim 8, wherein the film is adhesive on both sides.

10. The antenna according to claim 1, wherein all the square elements are electrically connected to the connector element, and the return conductor is connected to an electrically separate connector element.

* * * * *